US006364510B1

(12) United States Patent
Bernhart et al.

(10) Patent No.: US 6,364,510 B1
(45) Date of Patent: Apr. 2, 2002

(54) CEILING LIGHTING ASSEMBLY

(75) Inventors: Horst Bernhart, Fairhaven; George Pacheco, Fall River, both of MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/497,966

(22) Filed: Feb. 4, 2000

(51) Int. Cl.[7] ..... F21V 17/00

(52) U.S. Cl. ..... 362/365; 362/364; 362/370; 362/371; 362/297; 362/419; 362/457; 362/147

(58) Field of Search ..... 362/364, 370, 362/371, 297, 419, 457, 147, 365

(56) References Cited

U.S. PATENT DOCUMENTS 4,232,361 A * 11/1980 Kelsall ..... 362/364
4,382,274 A 5/1983 De Backer et al.
4,623,956 A 11/1986 Conti
4,704,664 A 11/1987 McNair
5,373,431 A 12/1994 Hayman et al.
5,457,617 A 10/1995 Chan et al.
5,800,050 A * 9/1998 Leadford ..... 362/296

* cited by examiner

*Primary Examiner*—Sandra O'Shea
*Assistant Examiner*—Ali Alavi
(74) *Attorney, Agent, or Firm*—Jeffrey A. Haeberlin; Middleton Reutlinger

(57) ABSTRACT

A recessed lighting fixture with a side mounted auxiliary device, the fixture being installable through an aperture of a ceiling mounting frame from below the ceiling and including a reflector housing with a lamp socket cup assembly connected thereto, a swing arm assembly with an auxiliary device, such as a second socket for a lamp, is attached to a side of the reflector housing.

14 Claims, 1 Drawing Sheet

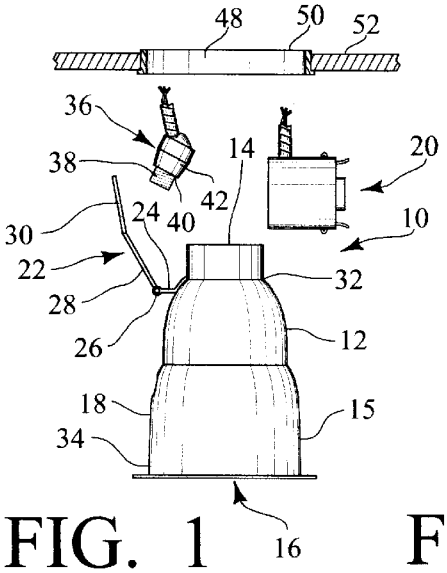
FIG. 1
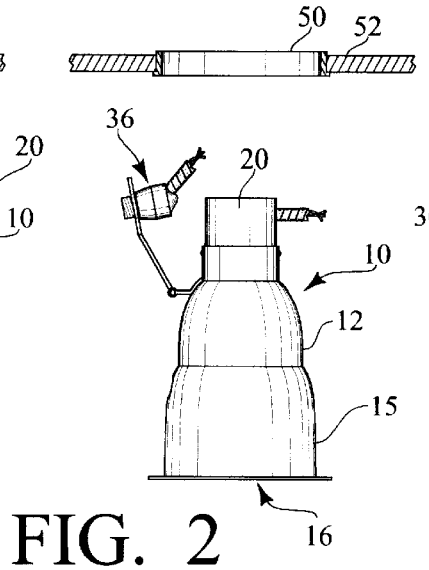
FIG. 2
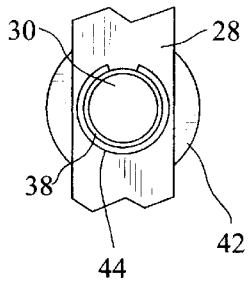
FIG. 3
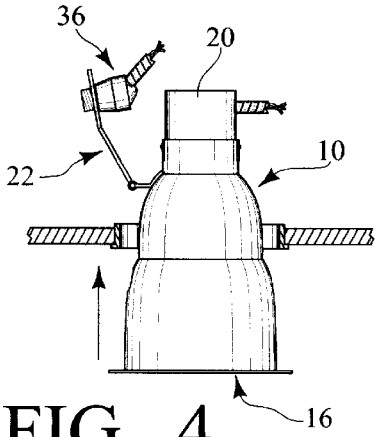
FIG. 4
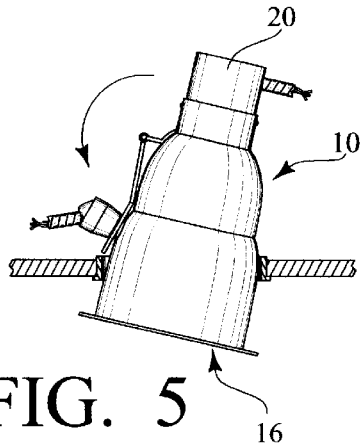
FIG. 5
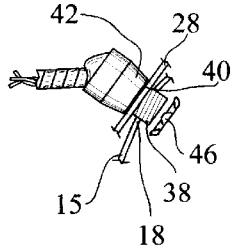
FIG. 6
FIG. 7
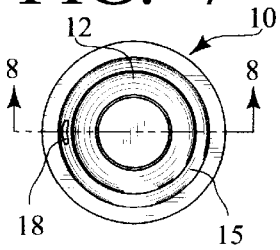
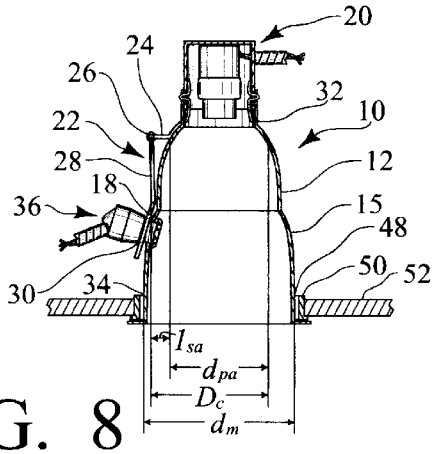
FIG. 8
FIG. 9
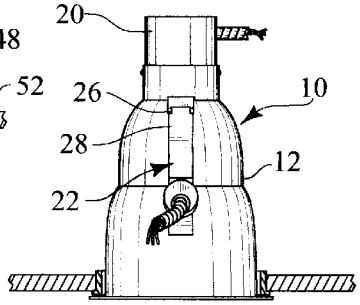

CEILING LIGHTING ASSEMBLY

BACKGROUND OF THE INVENTION

This invention relates to recessed ceiling lighting fixtures with auxiliary devices, and more particularly relates to an assembly which allows installation of a ceiling lighting fixture with an auxiliary device into an opening in a finished ceiling.

In providing recessed ceiling lighting fixtures for installation into finished ceilings, it is standard practice to provide such fixtures in multiple parts, such as a mounting frame, a reflector housing, and a socket cup assembly. The mounting frame generally installs into an opening in a finished ceiling and appropriate wiring is connected to the socket cup assembly. The socket cup assembly can be attached to the reflector housing below the ceiling. Then, the reflector housing can be inserted into the mounting frame. The mounting frame mechanically engages the reflector housing and supports the assembly above the ceiling.

It is sometimes desirable to install devices on the side of the reflector housing. For example, an auxiliary lamp is sometimes necessary or desired and the side mount position is optimal for its proper operation. However, the major outer diameter of the reflector housing usually fits tightly into the mounting frame opening. This tight mechanical fit does not provide means so that other devices may be mounted to the sides of the reflector housing because they would interfere with insertion in and removal from the mounting frame. Thus, a means for easy mounting of an auxiliary device to the reflector housing is desired.

SUMMARY OF THE INVENTION

It is an object of the present invention to provide a recessed lighting fixture with a side mounted auxiliary device, such as an auxiliary lamp, indicator light or test switch for a battery backup system, motion detector, dimmer switch, or an overload breaker/fuse, where the fixture is installable and removable through an opening of a mounting frame from below the ceiling. This invention is useful for installation of such a fixture in any ceiling, but is necessary for installation of such a fixture in a finished ceiling where the installer has no access to the area above the ceiling. Further, it is necessary that such fixtures also be removable to that service personnel may have access to the fixture junction box after installation. This invention allows such access.

It is another object of the present invention to locate an auxiliary device on a swing bracket that is retractable wherein the width of a reflector sub-assembly may be reduced for insertion of the sub-assembly through a lighting fixture frame opening, while allowing the auxiliary device and bracket to swing into place for final assembly.

More particularly, the present invention provides a recessed lighting fixture including: a generally conical reflector housing having openings for a primary lamp and an auxiliary device, and a light exit aperture; a primary lamp socket cup assembly connected to said conical reflector housing; a swing arm assembly attached to a side of said conical reflector housing; a positionable auxiliary device attached to the swing arm assembly; and a mounting frame, said reflector housing fitting within an opening in the mounting frame.

BRIEF DESCRIPTION OF THE FIGURES

FIG. 1 is a front view of the fixture of the preferred embodiment of the present invention in an unassembled state.

FIG. 2 is a front view of the fixture of FIG. 1 in a partially assembled state.

FIG. 3 is a partial view of an auxiliary socket assembled to the swing arm assembly of FIG. 1.

FIGS. 4 and 5 are side sectional views of the fixture of FIG. 1 being installed in a ceiling frame.

FIG. 6 is a partial exploded view of the fixture of FIG. 5 with the auxiliary socket assembled to the reflector housing.

FIG. 7 is a bottom view of the fixture of FIG. 1.

FIG. 8 is a front sectional view taken along line 8—8 of FIG. 7 with a swing arm assembly in an extended, assembled position.

FIG. 9 is a side view of the fixture of FIG. 1 with the swing arm assembly in the extended, assembled position.

DETAILED DESCRIPTION OF THE PREFERRED EMBODIMENT

The preferred embodiment of the present invention utilizes an auxiliary lamp as the auxiliary device mounted to the side of the reflector housing. However, it is possible to install any of a number of auxiliary devices using the swing arm assembly of the present invention. Such other devices may include a test switch/indicator light for a battery backup system, a motion detector device, a light dimmer, or an overload breaker/fuse.

A recessed lighting fixture 10, as shown in the figures in both assembled and disassembled states, has a conical reflector housing 12, a detachable socket cup assembly 20, a swing arm assembly 22, an auxiliary socket 36, and a mounting frame 50.

Conical reflector housing 12 has a primary lamp opening 14, a sidewall 15, and a light exit aperture 16. As shown in FIG. 7, reflector housing 12 is also provided with an auxiliary lamp opening 18.

In the preferred embodiment of the invention, primary lamp opening 14 is located at the minor diameter end 32 of the conical reflector housing 12, and the auxiliary lamp opening 18 is located on the sidewall 15 of the reflector housing 12. Light exit aperture 16 is located at the major diameter end 34 of the conical reflector housing 12.

A primary lamp socket cup assembly 20 is attached to the reflector housing 12 in proximity to the primary lamp opening 14 in order to provide power to a primary lamp and to hold the primary lamp in a proper position in the reflector housing 12. In the preferred embodiment, primary lamp socket cup assembly 20 is detachable from the reflector housing 12 so that it may be easily wired to the appropriate power source without the installer having to support the other components of the fixture during wiring. FIGS. 1 and 2 show the socket cup assembly 20 in the detached and attached configurations, respectively.

A swing arm assembly 22 is attached to the conical reflector housing 12. The swing arm assembly 22 includes a short arm 24, a hinge 26, a long arm 28, and an auxiliary socket receiving aperture 30. The short arm 24 of the swing arm assembly 22 is attached toward a minor diameter end 32 of the conical reflector housing 12 such that, as shown in FIG. 8, the combined distance $D_c$ of the length of short arm 24 $l_{sa}$ and the diameter of the conical reflector housing at the point of attachment $d_{pa}$ is less than the diameter of the reflector housing at the major diameter end 34 $d_m$. The long arm 28 of the swing arm assembly 22 is attached to the short arm 24 via the hinge 26. The auxiliary socket receiving aperture 30 is provided in the long arm 28 and positioned so that the aperture 30 aligns with the auxiliary lamp opening 18 on the side of the reflector housing 12 when the long arm 28 is in its downwardly extended position. FIGS. 1 and 8 show the positioning of the auxiliary socket receiving aperture 30 and the auxiliary lamp opening 18 with the long arm 28 in its upwardly extended position and downwardly extended position, respectively. FIG. 9 is another view of the fixture with long arm 28 in its downwardly extended position.

FIG. 1 also shows an auxiliary socket 36 including a short protruding neck 38, a shoulder 40, and a socket body 42. The auxiliary socket 36 is attached to the long arm 28 of the swing arm assembly 22, by placing the neck 38 through the auxiliary socket receiving aperture 30 oriented toward the reflector housing 12 such that the shoulder 40 rests against an exterior side of the long arm 28. As shown in FIG. 3, a "C" washer 44 placed around the neck 38 on the interior side of the long arm 28 serves to hold the auxiliary socket 36 in the socket receiving aperture 30.

A mounting frame 50 is attached to ceiling 52 and has conical housing receiving hole 48, which is sized to receive and mechanically engage the conical reflector housing 12 at its major diameter end 34. Such mechanical engagement may be by any of a number of means, such as resilient arms or mechanical fasteners, i.e. screws or rivets.

The design of the preferred embodiment allows the detachable socket cup assembly 20 to be assembled to the reflector housing 12 and the auxiliary socket 36 to be assembled to the swing arm assembly 22 below the ceiling 52, as shown in FIGS. 1 and 2. Once assembled, swing arm assembly 22 with auxiliary socket 36 is flipped straight up and held in that position while the reflector housing 12 is inserted half way into mounting frame 50, as shown in FIG. 4. The auxiliary socket 36 may then be swung into position by tilting reflector housing 12 as shown in FIG. 5 and allowing the swing arm assembly 22 to fall into a downwardly extended position such that auxiliary socket neck 38 aligns with and protrudes through reflector housing auxiliary lamp opening 18. Once in this position, the auxiliary socket 36 is secured to the reflector housing 12 by tightening a nut 46 down onto the neck 38 as shown in FIG. 6.

Conical reflector housing 12 can then be inserted the remainder of the way into mounting frame 50. Mounting frame 50 mechanically engages reflector housing 12 at it major diameter end 34 to complete installation.

This detailed description is given primarily for clearness of understanding and no unnecessary limitations are to be understood therefrom for modifications will become obvious to those skilled in the art upon reading this disclosure and may be made without departing from the spirit of the present invention and scope of the appended claims.

What is claimed is:

1. A recessed lighting fixture comprising:

a. a reflector housing, said reflector housing having a generally conically shaped sidewall with a minor diameter end and an opposed major diameter end, said sidewall having an opening in a side of said sidewall;

b. a primary lamp socket cup assembly connected to said reflector housing at said minor diameter end;

c. a swing arm assembly attached to said sidewall of said reflector housing;

d. an auxiliary electrical device attached to the swing arm assembly and extending into said opening in said side of said sidewall; and e. a mounting frame engaging and holding said reflector housing and its attachments in place above a ceiling.

2. The recessed lighting fixture according to claim 1 in combination with a primary lamp and an auxiliary lamp.

3. The recessed lighting fixture according to claim 1 wherein said primary lamp opening is located at the minor diameter end of the conical reflector housing, said auxiliary device opening is located on the sidewall of the conical reflector housing, and said light exit aperture is located at the major diameter end of the conical reflector housing.

4. The recessed lighting fixture according to claim 1 wherein said primary lamp socket cup assembly is attached to the reflector housing in proximity to the primary lamp opening.

5. The recessed lighting fixture according to claim 4 wherein said primary lamp socket cup assembly is detachable from the reflector housing.

6. The recessed lighting fixture according to claim 1 wherein said swing arm assembly comprises:

a. a short arm comprising two ends, one end of said short arm being attached to the reflector housing toward the minor diameter end such that the combined distance of the length of the short arm and the diameter of the reflector housing at the point of attachment is less than the diameter of the reflector housing at the major diameter end;

b. a hinge located at and connected to the other end of the short arm; and c. a long arm connected to the hinge and having an auxiliary device receiving aperture, said auxiliary device receiving aperture being aligned with the auxiliary device opening on the sidewall of the reflector housing when the long arm is in a downwardly extended position.

7. The recessed lighting fixture according to claim 6 wherein said auxiliary device is an auxiliary lamp socket comprising a socket body, a neck protruding from the socket body, and a shoulder formed where the neck protrudes from the socket body, said auxiliary lamp socket neck protruding through said long arm auxiliary device receiving aperture oriented toward the reflector housing such that said auxiliary lamp socket shoulder rests against an exterior side of said long arm.

8. The recessed lighting fixture according to claim 7 wherein the auxiliary lamp socket is held in the auxiliary device receiving aperture by a "C" washer, said "C" washer placed around the neck on the interior side of the long arm.

9. The recessed lighting fixture according to claim 7 wherein the auxiliary lamp socket is held in the conical reflector housing auxiliary device opening by a nut, said nut threaded over said neck.

10. The recessed lighting fixture according to claim 1 wherein said mounting frame has a conical housing receiving hole, said conical housing receiving hole sized to receive and mechanically engage said conical housing at its major diameter end.

11. The recessed lighting fixture according to claim 6 wherein said auxiliary device is an indicator light for a battery backup system or an indicator light in combination with a test switch for a battery backup system.

12. The recessed lighting fixture according to claim 6 wherein said auxiliary device is a motion detector device.

13. The recessed lighting fixture according to claim 6 wherein said auxiliary device is a light dimmer.

14. The recessed lighting fixture according to claim 6 wherein said auxiliary device is an overload breaker.

* * * * *